US009478376B2

(12) United States Patent
Miki

(10) Patent No.: US 9,478,376 B2
(45) Date of Patent: Oct. 25, 2016

(54) VACUUM INTERRUPTER

(75) Inventor: Shinichi Miki, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 178 days.

(21) Appl. No.: 13/696,120

(22) PCT Filed: May 7, 2010

(86) PCT No.: PCT/JP2010/003136

§ 371 (c)(1),
(2), (4) Date: Nov. 5, 2012

(87) PCT Pub. No.: WO2011/138819

PCT Pub. Date: Nov. 10, 2011

(65) Prior Publication Data

US 2013/0048611 A1 Feb. 28, 2013

(51) Int. Cl.

*H01H 33/66* (2006.01)
*H01H 33/662* (2006.01)
*H01H 3/60* (2006.01)

(52) U.S. Cl.

CPC ..... *H01H 33/66238* (2013.01); *H01H 3/60* (2013.01); *H01H 33/66207* (2013.01); *H01H 33/66261* (2013.01)

(58) Field of Classification Search

CPC ..... H01H 33/66; H01H 33/66261; H01H 33/66238
USPC ..... 218/135, 136, 137, 138; 200/288
See application file for complete search history.

(56) References Cited

U.S. PATENT DOCUMENTS 3,440,377 A * 4/1969 Wesoloski ..... 218/135
3,590,184 A * 6/1971 Wachta ..... H01H 33/66261 218/136
3,898,406 A * 8/1975 Larkin ..... 218/134

(Continued)

FOREIGN PATENT DOCUMENTS

JP 51-63470 A 6/1976
JP 53-113375 A 9/1978
JP 6-12947 A 1/1994
JP 7-176242 A 7/1995
JP 2001-006503 A 1/2001

(Continued)

OTHER PUBLICATIONS

Office Action (Notice of Preliminary Rejection) issued Sep. 17, 2013, by the Korean Patent Office in corresponding Korean Patent Application No. 10-2012-7028963, and an English Translation of the Office Action. (7 pages).

(Continued)

*Primary Examiner* — Renee S Luebke
*Assistant Examiner* — Ahmed Saeed
(74) *Attorney, Agent, or Firm* — Buchanan Ingersoll & Rooney PC

(57) ABSTRACT

A vacuum interrupter includes a vacuum vessel configured with an insulator, a fixed end plate and a movable end plate fixed to both ends of the insulator. A fixed contact and a movable contact face each other inside the vacuum vessel. A movable conductor has one end fixed to the movable contact and the other end is extracted outside the vacuum vessel. A bellows has an accordion portion expanding and contracting with linear movement of the movable conductor. A bellows support member having a cylindrical shape is fixed to the vacuum vessel so that the accordion portion of the bellows contacts the inside of the bellows support member.

8 Claims, 2 Drawing Sheets

(56) References Cited

U.S. PATENT DOCUMENTS

| | | | | |
|---|---|---|---|---|
| 4,081,640 | A * | 3/1978 | Rich | H01H 33/664 218/123 |
| 4,481,390 | A * | 11/1984 | Kashiwagi et al. | 218/134 |
| 4,871,888 | A * | 10/1989 | Bestel | H01H 33/6642 218/127 |
| 5,777,287 | A * | 7/1998 | Mayo | H01H 33/6642 200/275 |
| 5,791,416 | A * | 8/1998 | White et al. | 166/285 |
| 6,043,446 | A | 3/2000 | Mayo et al. | |
| 6,891,121 | B2 * | 5/2005 | Ren | H01H 33/664 218/123 |
| 6,965,089 | B2 * | 11/2005 | Stoving | H01H 33/6645 218/123 |
| 7,186,942 | B1 * | 3/2007 | Slade | H01H 33/6661 218/120 |

FOREIGN PATENT DOCUMENTS

| | | | |
|---|---|---|---|
| JP | 2003-187679 | A | 7/2003 |
| KE | 8-31280 | A | 2/1996 |

OTHER PUBLICATIONS

International Search Report (PCT/ISA/210) issued on Jun. 1, 2010, by the Japanese Patent Office as the International Searching Authority for International Application No. PCT/JP2010/003136.

Office Action issued Jun. 19, 2014, by the Chinese Patent Office in corresponding Chinese Patent Application No. 201080066639.X, and an English Translation of the Office Action. (9 pages).

Office Action issued by the German Patent Office on Jul. 3, 2015, in corresponding DE Patent Application No. 11 2010 005 545.9, with full English Translation (10 pages).

* cited by examiner

VACUUM INTERRUPTER

TECHNICAL FIELD

The present invention relates to a vacuum interrupter, especially to that provided with a bellows.

BACKGROUND ART

In a vacuum interrupter, a movable conductor is provided with a bellows, and airtightness of a vacuum vessel is maintained by expanding and contracting of the bellows with an operation of the movable conductor. The bellows is generally configured of metal such as stainless steel.

Atmospheric air or pressurized insulation gas is contained inside the bellows. On the other hand, vacuum is applied to the outer side of the bellows because its outside is inside the vacuum interrupter. Thus, because the inside pressure of the bellows is higher than the outside pressure of the bellows, and both ends of the bellows are restrained, buckling in which the bellows deforms may occur when a switch opening operation of the movable conductor is performed.

As a counter-measure for this problem, by increasing the outer diameter of the bellows, the buckling can be made difficult to occur.

As another counter-measure, for example, a vacuum interrupter can also be possible, in which a bellows is arranged outside a vacuum vessel as represented in Patent Document 1, and an end of the bellows is fixed to a movable end plate, while the other end is connected to a movable contact. According to this structure, because the inner side of the bellows is in a vacuum state, and the outer side of the bellows is in an atmospheric air or a pressurized insulation gas state, the buckling is difficult to occur.

PRIOR ART DOCUMENTS

Patent Documents

Patent Document 1

Japanese Laid-Open Patent Publication No. 2003-187679 (page 2, FIG. 6)

DISCLOSURE OF THE INVENTION

Problems to be Solved by the Invention

However, as the conventional vacuum interrupter described above, if the outer diameter of the bellows is increased or the bellows is put outside the vacuum vessel, a problem may occur that the overall vacuum interrupter is enlarged.

An objective of the present invention, which is made to solve the above described problem, is to prevent the enlarging of the vacuum interrupter as well as the buckling of the bellows.

Means for Solving the Problem

In a vacuum interrupter according to the present invention, a bellows is arranged inside a vacuum vessel, and a bellows support member having a cylindrical shape is fixed to the vacuum vessel so that an accordion portion of the bellows contacts thereinside.

Advantageous Effect of the Invention

According to the vacuum interrupter of the present invention, the increase of the vacuum interrupter size is prevented as well as the buckling of the bellows can be prevented.

MODE FOR CARRYING OUT THE INVENTION

Embodiment 1

Figure 1:
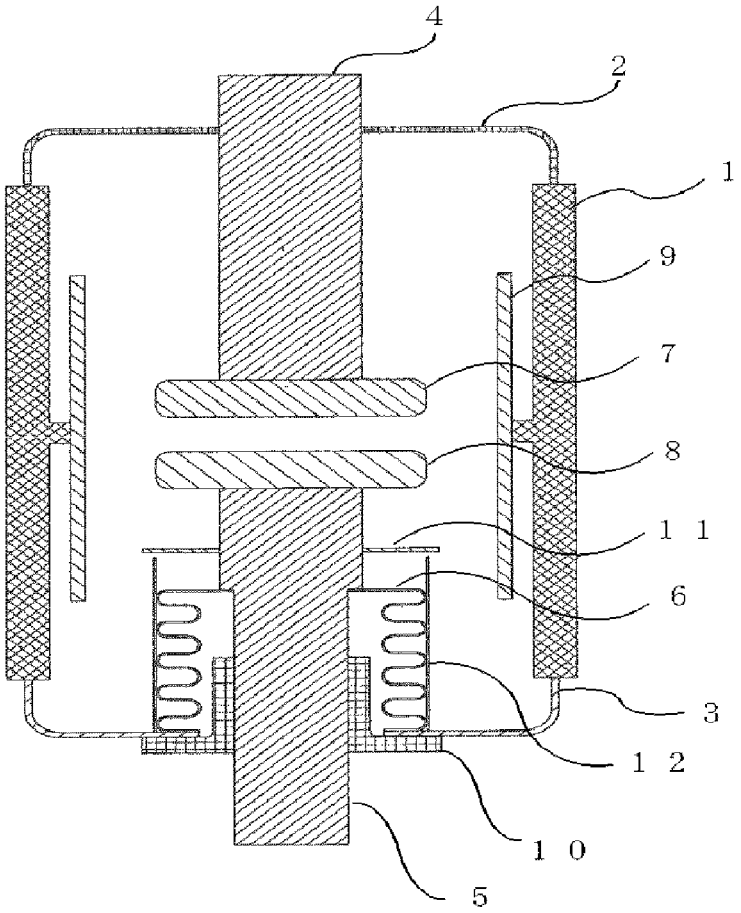
FIG. 1 is a vertical cross-sectional view illustrating a vacuum interrupter according to Embodiment 1 of the present invention.

FIG. 1 is a cross-sectional view illustrating a vacuum interrupter according to Embodiment 1 of the present invention. Hereinafter, a configuration of the vacuum interrupter according to Embodiment 1 of the present invention is explained based on FIG. 1. An insulator 1 having a cylindrical shape is configured of material such as alumina ceramic. A fixed end plate 2 and a movable end plate 3 are fixed by brazing to respective both ends of the insulator 1, which constitute a vacuum vessel. Silver brazing material is mainly used for such brazing bonding.

A fixed conductor 4 penetrates through the fixed end plate 2 to be bonded by brazing. One end of a bellows 6 is bonded by brazing to the movable end plate 3, while the other end is bonded by brazing to a movable conductor 5 penetrating through the inner portion of the bellows 6 and the movable end plate 3. The side of the bellows 6 has an accordion portion where mountains and valleys are alternately formed, and thereby configured to be expandable and contractable in an up-and-down direction in the figure. As material for the bellows 6, metal such as stainless steel can be used. In the vacuum vessel, a fixed contact 7 is bonded by brazing to an end of the fixed conductor 4, while a movable contact 8 is bonded by brazing to an end of the movable conductor 5, and the fixed contact 7 and the movable contact 8 are arranged to face each other.

The movable conductor 5 is configured to be linearly movable in an up-and-down direction in the figure. When the fixed contact 7 and the movable contact 8 are in contact with each other, the bellows 6 is in the most expanded state. When the fixed contact 7 and the movable contact 8 are in the most distant positions from each other within the movable range of the movable conductor 5, the bellows 6 is in the most contracted state.

An arc shield 9 having a cylindrical shape has a radius a little smaller than that of the insulator 1. The arc shield 9 is fixed by brazing to the inner face of the insulator 1 in such a way that the center axis of the arc shield 9 coincides with that of the insulator 1 and the arc shield 9 surrounds the fixed contact 7 and the movable contact 8. The arc shield 9 prevents the inner face of the insulator 1 from being stained by metal vapor generated from the fixed contact 7 and the movable contact 8 when current is interrupted.

After fabrication of the vacuum interrupter has been completed by brazing, a guide 10 for guiding linear movement of the movable conductor 5 is fixed to the movable end plate 3 by screws, etc. (not illustrated). The guide 10 limits the movement of the movable conductor 5 in directions other than the up-and-down direction in the figure.

In an end portion of the bellows 6 on the side of the movable contact 8, a bellows shield 11 is bonded by brazing to the movable conductor 5 so as to shield the bellows 6 from the fixed contact 7 and the movable contact 8. The bellows shield 11 prevents the surface of the bellows 6 from being stained by metal vapor generated from the fixed contact 7 and the movable contact 8 when current is interrupted.

A bellows support member 12 is a cylindrically formed member for preventing buckling of the bellows 6. The central axis of the bellows support member 12 coincides with that of the bellows 6. The bellows support member 12 has a length in an axis direction enough to cover the entire accordion portion in a state where the bellows 6 is most expanded, and an end thereof is bonded by brazing to the movable end plate 3. As material configuring the bellows support member 12, metal such as stainless steel can be used.

The radius of the bellows support member 12 is set to the same value as the distance from the center axis to the peaks of the accordion portion of the bellows 6 in the most contracted state so that the outer face of the peaks of the accordion portion of the bellows 6 just contacts the inside of the bellows support member 12 in the most contracted state of the bellows 6.

Here, because atmospheric air or pressurized insulation gas is contained inside the bellows 6, in a state of vacuum being applied to the outer side of the bellows 6, the pressure difference occurs between the inner side and the outer side of the bellows 6.

Next, an operation of the vacuum interrupter according to Embodiment 1 of the present invention is explained. In a switch closing state, the fixed contact 7 and the movable contact 8 are in contact with each other. When excessive current flows in this state, the vacuum interrupter starts a switch opening operation, and by the movable conductor 5 moving linearly toward the lower direction in FIG. 1, the fixed contact 7 and the movable contact 8 separate from each other, thereby the switch being opened. At this time, downward stress in FIG. 1 is also applied to the bellows 6, and with the linear movement of the movable conductor 5, the bellows 6 is contracted toward the lower direction in FIG. 1, thereby the vacuum interrupter functioning to maintain airtightness of the vacuum vessel.

Here, because of the pressure difference between the inner side and the outer side of the bellows 6, due to the above-described stress, buckling that the bellows 6 is deformed outward might occur. However, in the vacuum interrupter according to Embodiment 1 of the present invention, because the bellows support member 12 contacts the accordion portion of the bellows 6, and holds the bellows 6 not to be deformed outward, the buckling can be prevented.

When the movable conductor 5 is rapidly accelerated or decelerated, vibration occurs in the bellows 6; however, due to the vibration energy propagating through the bellows 6 being consumed by friction between the bellows support member 12 and the bellows 6, the vibration in the bellows 6 attenuates.

As described above, in the vacuum interrupter according to Embodiment 1 of the present invention, by arranging the bellows support member 12 to contact the accordion portion of the bellows 6, while preventing size increase of the vacuum interrupter, the buckling of the bellows 6 can be prevented.

In a vacuum interrupter which is opened and closed in a high speed, at the first step where rapid acceleration is performed and at the last step where rapid deceleration is performed during an open/close operation, a bellows thereof receives impact force, and then vibration occurs in the bellows; however, in the vacuum interrupter according to Embodiment 1 of the present invention, because the bellows support member 12 is arranged to contact the entire accordion portion of the bellows 6, the vibration energy propagating through the bellows 6 is consumed by the friction with the bellows support member 12, thereby attenuating the vibration in the bellows 6. Accordingly, because the stress occurring in the bellows 6 is reduced, the life time of the bellows 6 can be extended.

Here, between a state of the bellows 6 being contracted and that being expanded, the distance from the center axis to the peaks of the accordion portion of the bellows 6 slightly varies. Accordingly, it may be configured in such a way that the bellows support member has elasticity in a radius direction by using elastomer such as rubber as material of the bellows support member 12, and the bellows 6 is fastened. Consequently, even when the bellows 6 is not in the most contracted state, the bellows 6 and the bellows support member 12 are in contact with each other, whereby the buckling can be more surely prevented.

Embodiment 2

Figure 2:
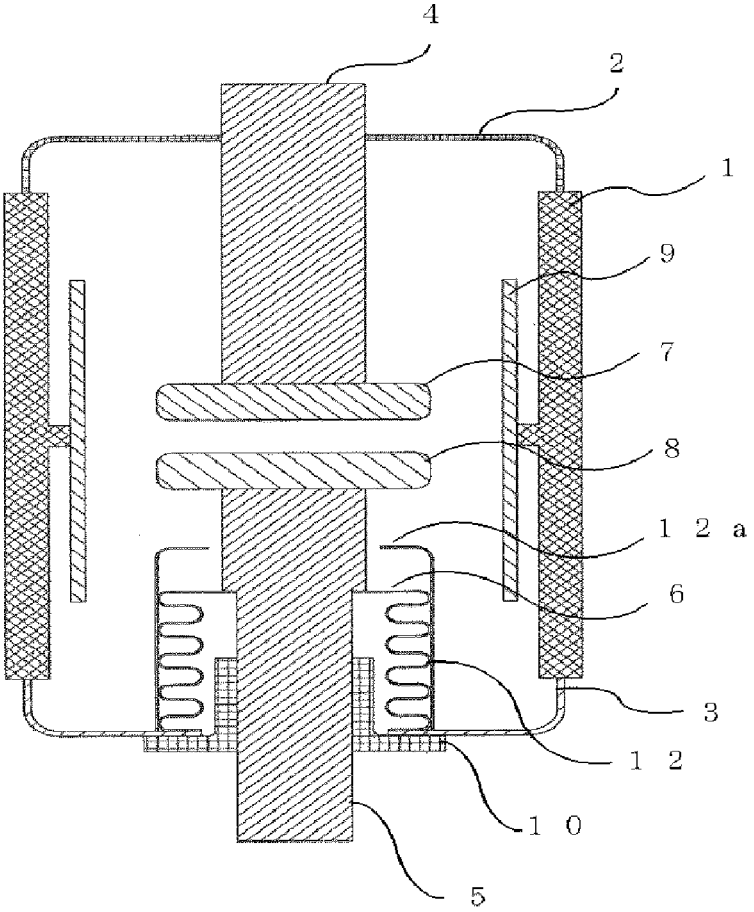
FIG. 2 is a vertical cross-sectional view illustrating a vacuum interrupter according to Embodiment 2 of the present invention.

FIG. 2 is a vertical cross-sectional view illustrating a vacuum interrupter according to Embodiment 2 of the present invention. The same numerals are given to the same components as those in FIG. 1, and their explanation is omitted. Regarding also the vacuum interrupter according to Embodiment 2 of the present invention, its basic configuration is the same as that according to Embodiment 1.

The difference from the vacuum interrupter according to Embodiment 1 is that in Embodiment 2 the bellows shield 11 is removed from the vacuum interrupter in Embodiment 1, and instead a shielding portion 12*a* is integrally formed at an end of the bellows support member 12 on the side of the movable contact 8. The shielding portion 12*a* is arranged at a position, intervening between the contact side edge of the bellows 6 and the movable contact 8, where the shielding portion 12*a* does not contact the movable contact 8 during the open/close operation. The shielding portion 12*a* shields between the movable contact 8 and the side edge of the movable contact 8 of the bellows 6.

Because the shielding portion 12*a* functions similarly to the bellows shield 11, the bellows 6 can be prevented from being stained by metal vapor generated from the fixed contact 7 and the movable contact 8 when current is interrupted.

As described above, in the vacuum interrupter according to Embodiment 2 of the present invention, due to the shielding portion 12*a* being integrally formed with the bellows support member 12, the operation of fixing the bellows shield 11 is needless, and the number of the parts can be reduced, thereby facilitating the assembly.

EXPLANATION OF REFERENCES

1: Insulator
2: Fixed end plate
3: Movable end plate
4: Fixed conductor
5: Movable conductor
6: Bellows
7: Fixed contact
8: Movable contact
9: Arc shield
10: Guide
11: Bellows shield
12: Bellows support member
12*a*: Shielding portion

What is claimed is:

1. A vacuum interrupter comprising:

a vacuum vessel, having a first end plate and a second end plate, formed by encapsulating both ends of an insulator between the first end plate and the second end plate;

a fixed contact fixed to the first end plate and a movable contact supported by the second end plate, wherein the fixed contact and the movable contact are arranged facing each other inside the vacuum vessel;

an arc shield surrounding the fixed contact and the movable contact;

a movable conductor, an end of which is fixed to the movable contact and the other end of which is extracted outside the vacuum vessel, for contacting the movable contact to and departing the movable contact from the fixed contact due to linear movement of the movable conductor;

a bellows, arranged inside the vacuum vessel, having an accordion portion expanding and contracting with the linear movement of the movable conductor;

a bellows support member for preventing the bellows from buckling, having a cylindrical shape and being fixed to the second end plate, wherein the bellows support member surrounds a circumference of the bellows and extends beyond an end of the bellows closest to the movable contact, wherein the bellows support member has a length in an axial direction enough to cover the entire accordion portion of the bellows in a state where the bellows is most expanded, and wherein the accordion portion of the bellows contacts an inside of the bellows support member when the bellows is in a contracted state; and a shielding portion for shielding between the movable contact and the bellows, wherein the shielding portion is disc-shaped and covers an opening of the bellows support member and wherein the bellows are covered by the bellows support member and the shielding portion in a state where the bellows is contracted.

2. A vacuum interrupter as recited in claim 1, wherein the bellows support member has a radius approximately the same as a distance from a center axis to a peak of the accordion portion of the bellows in the most contracted state.

3. A vacuum interrupter as recited in claim 1, wherein the bellows support member has elasticity in a radial direction.

4. A vacuum interrupter as recited in claim 1, wherein the shielding portion is arranged between the movable contact and an end of the bellows closest to the movable contact.

5. A vacuum interrupter as recited in claim 1, wherein the bellows support member is located radially interior of the arc shield within the vacuum vessel.

6. A vacuum interrupter comprising:

a vacuum vessel, having a first end plate and a second end plate, formed by encapsulating both ends of an insulator between the first end plate and the second end plate;

a fixed contact fixed to the first end plate and a movable contact supported by the second end plate, wherein the fixed contact and the movable contact are arranged facing each other inside the vacuum vessel;

an arc shield surrounding the fixed contact and the movable contact;

a movable conductor, an end of which is fixed to the movable contact and the other end of which is extracted outside the vacuum vessel, for contacting the movable contact to and departing the movable contact from the fixed contact due to linear movement of the movable conductor;

a bellows, arranged inside the vacuum vessel, having an accordion portion expanding and contracting with the linear movement of the movable conductor;

a bellows support member for preventing the bellows from buckling, having a cylindrical shape and being fixed to the second end plate, wherein the bellows support member surrounds a circumference of the bellows and extends beyond an end of the bellows closest to the movable contact, wherein the bellows support member has a length in an axial direction enough to cover the entire accordion portion of the bellows in a state where the bellows is most expanded, and wherein the accordion portion of the bellows contacts an inside of the bellows support member when the bellows is in a contracted state; and a shielding portion for shielding between the movable contact and the bellows, wherein the shielding portion is arranged between the movable contact and an end of the bellows closest to the movable contact.

7. A vacuum interrupter as recited in claim 6, wherein the shielding portion for shielding between the movable contact and the bellows is integrally formed with an end of the bellows support member on the side of the movable contact.

8. A vacuum interrupter comprising:

a vacuum vessel, having a first end plate and a second end plate, formed by encapsulating both ends of an insulator between the first end plate and the second end plate;

a fixed contact fixed to the first end plate and a movable contact supported by the second end plate, wherein the fixed contact and the movable contact are arranged facing each other inside the vacuum vessel;

an arc shield surrounding the fixed contact and the movable contact;

a movable conductor, an end of which is fixed to the movable contact and the other end of which is extracted outside the vacuum vessel, for contacting the movable contact to and departing the movable contact from the fixed contact due to linear movement of the movable conductor;

a bellows, arranged inside the vacuum vessel, having an accordion portion expanding and contracting with the linear movement of the movable conductor; and a bellows support member for preventing the bellows from buckling, having a cylindrical shape and being fixed to the second end plate, wherein the bellows support member surrounds a circumference of the bellows and extends beyond an end of the bellows closest to the movable contact, wherein the bellows support member has a length in an axial direction enough to cover the entire accordion portion of the bellows in a state where the bellows is most expanded, wherein the accordion portion of the bellows contacts an inside of the bellows support member when the bellows is in a contracted state, and wherein the bellows support member is located radially interior of the arc shield within the vacuum vessel.

* * * * *